US009440201B2

(12) United States Patent
Hepperle et al.

(10) Patent No.: US 9,440,201 B2
(45) Date of Patent: Sep. 13, 2016

(54) DEVICE AND METHOD FOR GAS DISPERSION

(76) Inventors: Jens Hepperle, Köln (DE); Jörg Kirchhoff, Köln (DE); Klemens Kohlgrueber, Kürten (DE)

( * ) Notice: Subject to any disclaimer, the term of this patent is extended or adjusted under 35 U.S.C. 154(b) by 160 days.

(21) Appl. No.: 13/818,370

(22) PCT Filed: May 19, 2011

(86) PCT No.: PCT/EP2011/058135

§ 371 (c)(1),
(2), (4) Date: May 3, 2013

(87) PCT Pub. No.: WO2012/025264

PCT Pub. Date: Mar. 1, 2012

(65) Prior Publication Data

US 2013/0215710 A1 Aug. 22, 2013

(30) Foreign Application Priority Data

Aug. 24, 2010 (DE) ..... 10 2010 039 700

(51) Int. Cl.
*B01F 3/04* (2006.01)
*B01F 5/04* (2006.01)
(Continued)

(52) U.S. Cl.
CPC ..... *B01F 3/0446* (2013.01); *B01F 3/04503* (2013.01); *B01F 5/0451* (2013.01);
(Continued)

(58) Field of Classification Search
CPC ..... B01F 3/0446
USPC ..... 366/174.1, 175.2, 181.5, 336–339, 366/176.1
See application file for complete search history.

(56) References Cited

U.S. PATENT DOCUMENTS 4,062,524 A 12/1977 Brauner et al.
4,674,888 A 6/1987 Carlson
(Continued)

FOREIGN PATENT DOCUMENTS

DE 29923895 U1 5/2001
EP 1189686 A1 3/2002
(Continued)

OTHER PUBLICATIONS

International Search Report for PCT/EP2011/058135 mailed Aug. 31, 2011.
(Continued)

*Primary Examiner* — David Sorkin
*Assistant Examiner* — Abbas Rashid
(74) *Attorney, Agent, or Firm* — K&L Gates LLP

(57) ABSTRACT

The invention relates to a device for dispersing gas into a liquid. The devise has a number n of successive zones $Z_1$, $Z_2$, . . . , $Z_n$ having static mixing elements, wherein each zone $Z_i$ has a length $L_i$ and an effective diameter $D_i$. The mechanical energy input Et, which is standardized to the particular ratio $L_i/D_i$ and acts on the gas/liquid mixture, increases from zone to zone in the flow direction. In this connection n is a whole number greater than or equal to 3 and i is an index which runs through the whole numbers from 1 to the number n of zones. The invention further relates to a method for dispersing gas into a liquid using the device according to the invention.

8 Claims, 3 Drawing Sheets

(51) Int. Cl.
*B01F 5/06* (2006.01)
*B01F 13/10* (2006.01)

(52) U.S. Cl.
CPC ..... *B01F5/0615* (2013.01); *B01F 5/0619* (2013.01); *B01F 5/0646* (2013.01); *B01F 5/0651* (2013.01); *B01F 13/1025* (2013.01); *B01F 13/1027* (2013.01)

(56) References Cited

U.S. PATENT DOCUMENTS

| | | | | |
|---|---|---|---|---|
| 5,480,589 | A | 1/1996 | Belser et al. | |
| 5,520,460 | A | 5/1996 | Lantz | |
| 5,605,399 | A | 2/1997 | King | |
| 6,027,241 | A * | 2/2000 | King | 366/181.5 |
| 6,102,561 | A * | 8/2000 | King | 366/181.5 |
| 6,419,386 | B1 * | 7/2002 | Fleischli | B01F 3/10 239/402 |
| 2001/0053108 | A1 | 12/2001 | Jahn et al. | |
| 2004/0037161 | A1 * | 2/2004 | Honda | B01F 3/0807 366/176.1 |
| 2005/0094482 | A1 | 5/2005 | Foster et al. | |
| 2005/0239995 | A1 | 10/2005 | Kirchhoff et al. | |
| 2012/0106290 | A1 | 5/2012 | Meijer et al. | |
| 2012/0107324 | A1 | 5/2012 | Eberlein et al. | |

FOREIGN PATENT DOCUMENTS

| | | | |
|---|---|---|---|
| WO | WO-02/13618 | A2 | 2/2002 |
| WO | WO-2005103115 | A1 | 11/2005 |
| WO | WO-2010066457 | A1 | 6/2010 |

OTHER PUBLICATIONS

Pahl, M.H., et al., *Static Mixers and Their Applications* (1982), vol. 22, No. 2, International Chemical Engineering, pp. 197-205.
CAPLUS 1956:58846, DN 50:58846, abstracting, Siemes et al., Chemie-Ingenieur-Technik (1956), 28 (6), 389-395.
Siemes et al., Chemie-Ingenieur-Technik (1956), 28 (6), 389-395.

* cited by examiner

PRIOR ART

DEVICE AND METHOD FOR GAS DISPERSION

PRIORITY

Priority is claimed as a national stage application, under 35 U.S.C. §371, to PCT/EP2011/058135, filed May 19, 2011, which claims priority to German Application No. 10 2010 039 700.8, filed Aug. 24, 2010. Each disclosure of the aforementioned priority applications is incorporated herein by reference in its entirety.

BACKGROUND

The invention relates to a device and a method for dispersing gas in a liquid.

The dispersion of gases in liquid media is used widely in the chemical industry, for example in hydrogenations, chlorinations or oxidations. Oxygen input is of considerable importance in fermentation processes and aerobic wastewater treatment. Gas is also dispersed in a liquid medium in foam production. In food technology gases are dispersed in high-viscosity liquids, in order for example to produce creams, foam gums or chocolate with an air-filled porous structure (described for example in WO02/13618A2).

The objective of gas dispersion is to input gas into a fluid, preferably in the form of bubbles that are as small as possible, in order to produce a maximally large interface between the gaseous and liquid phases. The larger the phase interface, the greater the mass transfer between gas and liquid, in accordance with Fick's first law.

Gas dispersion here often proceeds in two steps:

1. introduction of the gas into the liquid in the form of bubbles
2. dispersal of the bubbles The method of introduction, in general by way of nozzles, frits or perforated plates, determines the size distribution of the primary bubbles. The article "Gasdispergierung in Flüssigkeiten durch Düsen bei hohen Durchsätzen" (gas dispersion in liquids using nozzles at elevated throughputs) from Chemie-Ingenieur-Technik, Volume 28, 1956, No. 6, pages 389-395 for example describes what effect parameters such as nozzle width, gas throughput, viscosity and interfacial tension have on the size distribution of gas bubbles, which arise on injection of a gas jet into a liquid from a nozzle.

Dispersal of the bubbles may proceed for example by means of a dynamic or static mixer. While in dynamic mixers homogenization of a mixture is achieved by moving members such as for example stirrers, in static mixers the flow energy of the fluid is exploited: a delivery unit (for example a pump) forces the liquid through a pipe provided with static internal mixer inserts, wherein the liquid following the main axis of flow is subdivided into partial streams, which are stretched, sheared, swirled together and mixed depending on the nature of the inserts. The advantage of using static mixers resides, inter alia, in the fact that no moving parts are present.

An overview of various types of static mixer is provided for example by the article "Statische Mischer and ihre Anwendungen" (static mixers and their applications), M. H. Pähl and E. Muschelknautz, Chem.-Ing.-Techn. 52 (1980) No. 4, pp. 285-291. Examples of static mixers which may be mentioned are SMX mixers (cf. U.S. Pat. No. 4,062,524) or SMXL mixers (cf. for example U.S. Pat. No. 5,520,460). They consist of two or more mutually perpendicular lattices of parallel sheet metal strips, which are joined together at their points of intersection and are placed at an angle relative to the main direction of flow of the material to be mixed, in order to divide the liquid into sub-streams and mix it. A single mixing element is unsuitable as a mixer, since thorough mixing only proceeds along a preferential direction across the main direction of flow. It is therefore conventional to arrange a plurality of mixing elements in succession, each rotated by 90° relative to one another.

The use of static mixers to disperse gas in a liquid is known. WO02005/103115A1 for example describes the use of a static mixer in a method for producing polycarbonate using the transesterification method. To remove monomers and other volatile constituents from the polycarbonate, a blowing agent is added to the polymer melt. When the pressure is subsequently lowered, the blowing agent escapes, foaming the melt. The foam brings about a major increase in surface area, which is advantageous for degassing, i.e. the removal of volatile constituents. An inert gas, such as nitrogen for example, is preferably used as the blowing agent, which inert gas is introduced into and dispersed in the melt by means of a static mixer, for example an SMX mixer.

US2005/0094482A1 and U.S. Pat. No. 5,480,589 describe static mixers for dispersing gases to produce closed-cell foams. A stepped structure for increasing the effectiveness of gas dispersion is not described.

Dispersion of gas in a liquid generally requires greater mixer lengths than the dispersion of liquids.

On the basis of the prior art, the object arises of providing a device and a method for dispersing gas in a liquid, in order to enable more effective gas dispersion than has been described in the prior art. Compared with the prior art, it is intended to achieve a smaller average bubble size at the mixer outlet while maintaining the same mixer length. Alternatively, a smaller average bubble size is to be achieved at the mixer outlet with an identical pressure drop over the entire mixer.

It has surprisingly been found that a static mixer, in which the specific energy input increases in the direction of flow, has a particularly effective dispersing action. Using such a mixer it is possible, with a comparable overall pressure drop, to produce smaller gas bubbles than with a static mixer, in which the energy input is constant over the length of the mixer. Using such a mixer it is likewise possible, with the same overall mixer length, to produce smaller gas bubbles than with a static mixer, in which the energy input is constant over the length of the mixer.

DESCRIPTION

Figure 1:
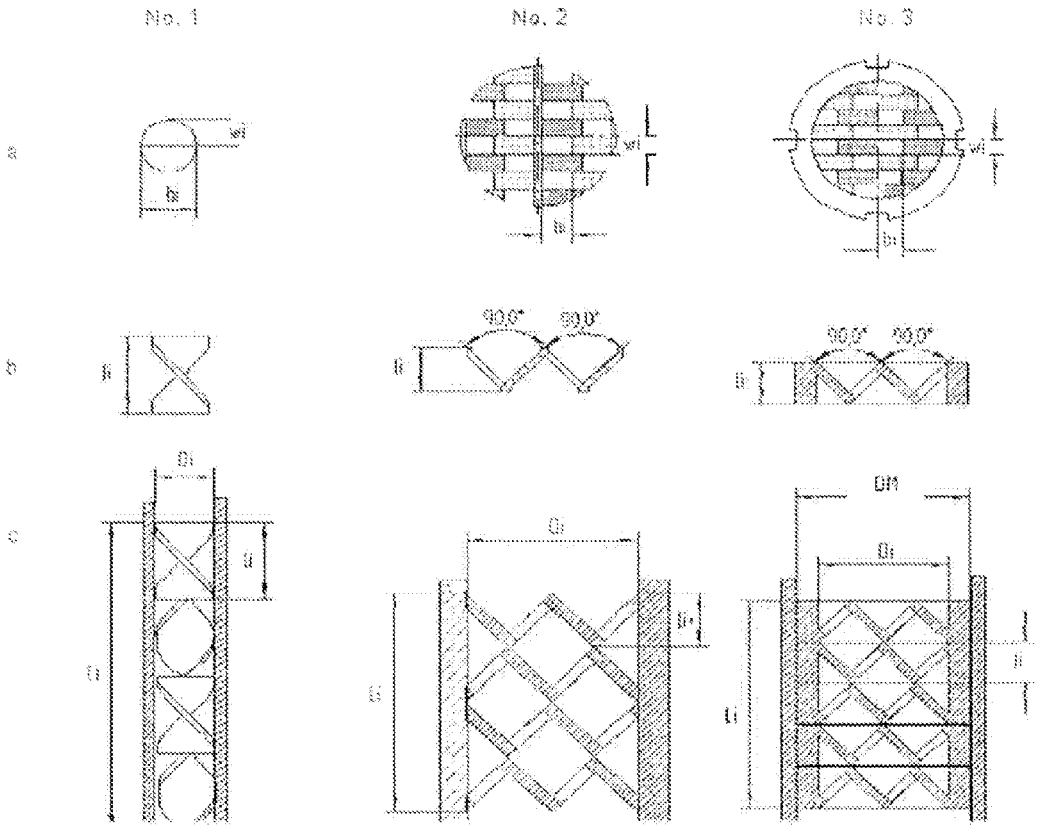
FIG. 1 shows examples of three different static mixers (No. 1, No. 2 and No. 3)

The present invention accordingly firstly provides a device for dispersing gas in a liquid with a number n of successive zones $Z_1, Z_2, \ldots, Z_n$ with static mixing elements, each zone $Z_i$ having a length $L_i$ and an effective diameter $D_i$, characterized in that the individual zones are constructed such that the mechanical energy input $E_i$ acting on the gas/liquid mixture and normalized to the respective ratio $L_i/D_i$ increases from zone to zone in the direction of flow, wherein n is an integer greater than or equal to 3 and i is an index which runs through the integers from 1 to the number n of zones.

The present invention further provides a device for dispersing gas in a liquid in which gas and liquid are conveyed jointly through a mixing device and, in the process, flow through a number n of successive zones $Z_1, Z_2, \ldots, Z_n$ with static mixing elements, each zone $Z_i$ having a length $L_i$ and an effective diameter $D_i$ characterized in that the mechanical energy input $E_i$ acting on the gas/liquid mixture and normalized to the respective ratio $L_i/D_i$ increases from zone to zone in the direction of flow, wherein n is an integer greater than or equal to 3 and i is an index which runs through the integers from 1 to the number n of zones.

Liquid is here understood generally to mean a medium which may be conveyed by the device according to the invention. It may for example also be a melt or a dispersion (for example emulsion or suspension). The term fluid is also used hereinafter. The fluid is here preferably of relative high viscosity, i.e. it has a viscosity of between 2 mPa·s and 10,000,000 mPa·s, particularly preferably between 1,000 mPa·s and 1,000,000 mPa·s (measured in a cone and plate viscosimeter according to DIN 53019 at a shear rate of 1 $s^{-1}$).

Mechanical energy is input into the mixture in order to disperse a gas or gas mixture in the fluid. This energy input is brought about by static mixing elements. In mixing technology it is conventional to use modular systems. A mixer is composed of a series of modular mixing elements. The mixing action may be increased by increasing the number of mixing elements in a mixer. Conventionally, the mixing elements are introduced into a pipe to form a static mixer. It should be pointed out that the present invention is not restricted to mixers which are built up from an arrangement of modular mixing elements, but rather is also applicable to mixers of compact design.

The device according to the invention is distinguished in that it has a number n of adjacent zones, wherein n is an integer greater than or equal to 3. Static mixing elements are present in each zone. Each zone $Z_i$ has a length $L_i$ and a cross-sectional area $A_i$. In this case i is an index which runs through the integers from 1 to the number n of zones. The length $L_i$ of a zone $Z_i$ corresponds to the length of the mixing elements arranged in series in this zone; the cross-sectional area $A_i$ corresponds to the cross-sectional area of the mixing elements present in the zone $Z_i$.

On the basis of the cross-sectional area $A_i$, it is possible to calculate an effective diameter $D_i$ according to equation 1:

$$D_i = \sqrt{\frac{4A_i}{\pi}} \tag{1}$$

In the case of a circular cross section, the effective diameter $D_i$ corresponds to the diameter of the circle. In the case of a non-circular (for example rectangular) cross section, the effective diameter $D_i$ corresponds to the diameter of a circle with a surface area which corresponds to the cross-sectional area.

The ratio $L_i/D_i$ is a characteristic value for the respective zone $Z_i$.

A mixing element has internal structures and channels between said structures. As a fluid is conveyed through a mixing element, the structures and channels have the effect of subdividing the fluid into sub-streams and distributing, shearing and optionally swirling it, the sub-streams thus being mixed together. The average diameter of a channel is abbreviated hereinafter with the letters $d_i$. An average channel diameter $d_i$ is understood to mean the effective channel diameter averaged arithmetically over all the channels, wherein the effective channel diameter may be calculated in accordance with equation 1 in the same way as the effective diameter of a zone $Z_i$.

$$d_i = \sqrt{\frac{4a_i}{\pi}} \tag{2}$$

The ratio $d_i/D_i$ between the average channel diameter $d_i$ and the effective diameter $D_i$ of the mixing elements in a zone $Z_i$ is likewise a characteristic value for the respective zone $Z_i$. The parameter $a_i$ in this case denotes the open cross-sectional area, more precisely the projected area of the free cross section. Thus, for example, in FIG. 1*a* the open cross-sectional area $a_i$ is obtained from the sum of the projected areas of the individual free cross-sectional areas of the open channels through which the fluid may flow (equation 3).

$$a_i = \sum_{m=1}^{N} b_{i,m} \cdot w_{i,m} \tag{3}$$

The parameter m is in this case a count parameter, while N is the number of individual free cross-sectional areas.

The static mixers used according to the prior art for gas dispersion have mixing inserts which remain the same over the length of the mixer. Here there is just one zone, whose length L corresponds to the length of the mixer and whose effective diameter D corresponds to the effective diameter of the mixer. The dispersing action of such a mixer may be increased, for example, by increasing the length L. As the length of the mixer increases, the pressure drop Δp increases linearly over the mixer. The mechanical energy input $E_{abs}$ is proportional to the pressure drop, according to equation (4), wherein V is the volumetric flow rate of the fluid.

$$E_{abs} \Delta p \cdot \dot{V} \tag{4}$$

The pressure drop Δp and thus the mechanical energy input may in the same way also be increased by reducing the effective diameter D.

The device according to the invention is distinguished by a number n of zones. Each zone $Z_i$ is characterized by a specific mechanical energy input $E_i$, which is input into a fluid flowing through the respective zone. The specific mechanical energy input $E_i$ is the mechanical energy input $E_{abs}$ normalized to the characteristic value $L_i/D_i$. In this case the following applies according to the invention $E_1 < E_2 < \ldots < E_n$.

$$E = \frac{E_{abs} \cdot D}{L} \tag{5}$$

The number n of zones in a device according to the invention is unlimited. It may be virtually infinite, if the zones are infinitesimally small and there is a continuously rising specific energy input over the length of the device, such as could be case for example with a conically tapering pipe.

It is feasible for further zones to exist up- or downstream of the zones $Z_i$ to $Z_n$, which have freely selectable specific energy inputs.

For instance, a particularly preferred embodiment of the device according to the invention is characterized in that it has a first zone $Z_0$ which achieves a higher specific energy input than the next zone $Z_1$ in the direction of flow (E0>E1). According to the invention the zone $Z_1$ is followed by further zones $Z_2$ to $Z_n$, wherein for the corresponding specific energy inputs $E_1$ to $E_n$ the following applies: $E_1<E_2< \ldots <E_n$. It has surprisingly been established that with such an arrangement of zones primary bubbles may be produced by zone $Z_0$, which have less of a tendency to coalesce in subsequent zones, more effective dispersion thus being achieved.

In a preferred embodiment, the device according to the invention has a number n of mixing zones, which are arranged in series, wherein the average channel diameter $d_i$ in the mixing zones becomes smaller in the direction of flow. Smaller channels produce a higher pressure drop per length, which is synonymous with an increasing specific energy input.

This embodiment preferably comprises a cylindrical pipe, into which mixing elements are inserted. The effective diameter $D_i$ of the mixing elements is here preferably constant over the entire pipe length, while the average channel diameter $d_i$ becomes smaller in successive zones in the direction of flow. $D_1=D_2= \ldots =D_n$ and $d_1>d_2> \ldots >d_n$ apply.

Mixing elements of the same type are preferably used, for example SMX mixers with different characteristic values d/D.

In a further preferred embodiment the device according to the invention has an arrangement of mixing elements which have an increasingly smaller effective diameter $D_i$ in the direction of flow with a constant ratio $d_i/D_i$.

$$\frac{d_1}{D_1} = \frac{d_2}{D_2} = \frac{d_i}{D_i} \ldots = \frac{d_n}{D_n}$$

and $D_1>D_2> \ldots >D_n$ apply.

This embodiment comprises a cylindrical pipe, into which mixing elements are inserted, which have an effective diameter $D_i$ which becomes increasingly smaller in the direction of flow.

The mixing elements whose external diameter is smaller than the internal diameter of the pipe are in this case preferably enclosed in a jacket pipe, whose external diameter corresponds approximately to the internal diameter of the pipe, so that they can be inserted into the pipe with a good fit. At the points of transition from a mixing element with a large diameter to a mixing element with a small diameter, transitional jacket pipes are preferably provided, which have internal diameters which taper conically towards the small-diameter mixing element. These transitional jacket pipes may be connected in one piece with the jacket pipes or be constructed separately.

In a further preferred embodiment, the device according to the invention has in each zone $Z_i$ an arrangement of mixing elements of different types, which at the same ratio $L_i/D_i$ cause an increasing pressure drop in each zone $Z_i$ in the direction of flow.

The mixing elements are inserted into a cylindrical pipe. They preferably have the same effective diameter $D_i$.

If the external diameters of the mixing element types vary, it is feasible to enclose those mixing elements whose external diameter is smaller than the internal diameter of the pipe with a jacket pipe or ring, whose external diameter approximately corresponds to the internal diameter of the pipe, in order to be able to insert it into the pipe with a good fit. The above-described use of transitional jacket pipes is also advantageous here.

It is feasible to combine together the various different embodiments.

The device according to the invention is suitable for dispersing gas in a liquid, for example for input of a carrier gas into a polymer melt or for foaming liquid media.

The gas may be added using tubes or thin capillaries which are preferably situated upstream of the static mixer cascade in the direction of flow. Furthermore, the gas may also be added through a porous body. A porous body may for example exhibit the following geometries: a frit and/or a porous, sintered body and/or a single- or multilayer screen.

The porous body may for example take the form of a cylinder, a cuboid, a sphere or a cube or be conical in shape, for example taking the form of a cone. These devices ensure fine predispersion of the gas and optionally also distribution of the gas over the cross section.

The capillary or the porous body exhibits an average effective internal hole diameter of from preferably 0.1-500 μm, preferably 1-200 μm, particularly preferably 10-90 μm.

The porous bodies may for example take the form of porous sintered bodies of metal, such as frit bodies, which are used in chromatography, for example the sintered bodies made by Mott Corporation (Farmington, USA). Furthermore, wound wire meshes may be used, for example the wound wire meshes made by Fuji Filter Manufacturing Co. Ltd. (Tokyo, Japan), trade name: Fujiloy®. Furthermore, screens or multilayer meshes may be used, such as for example the composite metal/wire mesh plates from Häver & Boecker Drahtweberei (Oelde, Germany), trade name Häver Porostar.

These devices serve in distributing the gas over the pipe cross section and in predispersion, favorable for gas dispersion, over the narrow pores. The effective diameter $D_i$ of the holes used in the sintered porous bodies or screens or wound wire meshes preferably amounts to 1-500 μm, particularly preferably 2-200 μm, very particularly preferably 10-90 μm.

The invention is explained in greater detail below with reference to examples, but without being limited to said examples.

FIG. 1 shows examples of three different prior art static mixers (No. 1, No. 2 and No. 3): FIG. 1(*a*) from above. FIG. 1(*b*) from the side (sectional drawing) and FIG. 1(*c*) in the arrangement after installation into a pipe or housing. The details for wi and bi denote the length or width of the projected cross section of the free flow channels. Di denotes the internal diameter and DM the external diameter of the static mixing elements. Li denotes the entire length of a geometrically uniform mixer portion and lithe length of one individual mixing element.

No. 1 represents a Kenics mixer. No. 2 shows a conventional commercial SMX static mixer with or without outer ring. No. 3 shows a mixer with web structure and outer ring (DE 29923895U1 and EP1189686B1).

Figure 2:
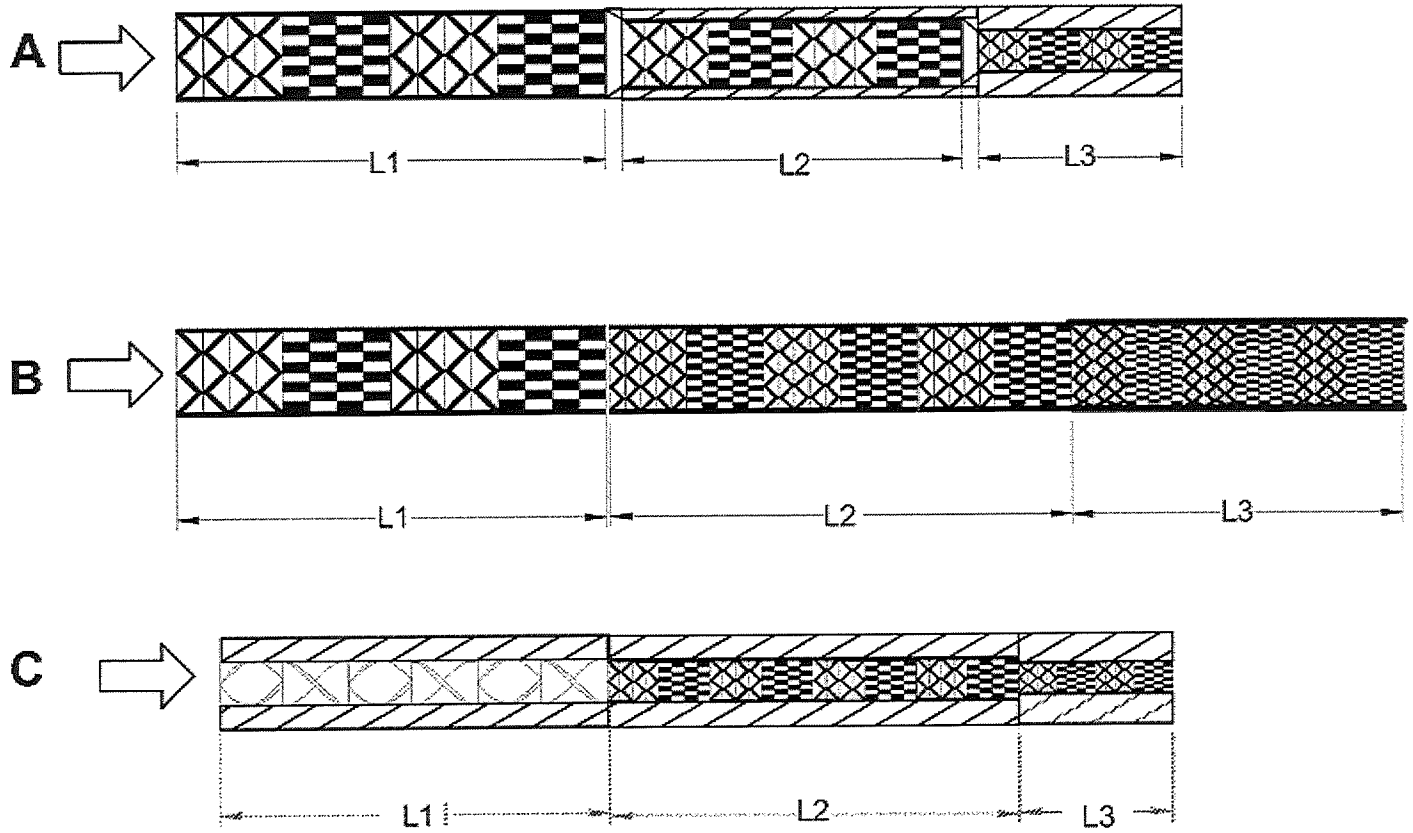
FIG. 2 shows three different examples (A, B and C) of variants of static mixers.

FIG. 2 shows three different examples (A, B and C) of variants of static mixers according to the invention, with individual zones (characterized by the length indications $L_1$, $L_2$, $L_3$), characterized in that the mechanical energy input $E_i$ normalized to the respective ratio $L_i/D_i$ of the individual zones and applied to a fluid flowing through the respective zone $Z_i$ increases in the direction of flow. The direction of flow is indicated by the thick arrow.

FIG. 2A shows a sequence of static mixers of geometrically similar structure and an arrangement of mixing elements which have increasingly smaller effective diameters $D_i$ in the direction of flow at a constant ratio $d_i/D_i$.

The following applies:

$$\frac{d_1}{D_1} = \frac{d_2}{D_2} = \frac{d_3}{D_3}$$

and $D_1>D_2>D_3$.

FIG. 2B shows an embodiment with a cylindrical pipe, into which mixing elements are inserted whose effective diameter $D_i$ is constant over the entire pipe length, while the average channel diameter $d_i$ becomes smaller in successive zones in the direction of flow. $D_1=D_2=D_3$ and $d_1>d_2>d_3$ apply. Mixing elements of the same type are used, for example SMX mixers with different characteristic values d/D.

FIG. 2C shows an arrangement of mixing elements of various types, which cause an increasing pressure drop in the direction of flow in each zone $Z_i$ at an identical ratio $L_i/D_i$. As an example, a Kenics mixer is shown here in the first zone of length L1. In the second zone of length L2 there is located an SMX mixer. In the third zone of length L3 there is likewise located an SMX mixer of smaller effective diameter $D_i$ than the mixer in the second zone.

Figure 3:
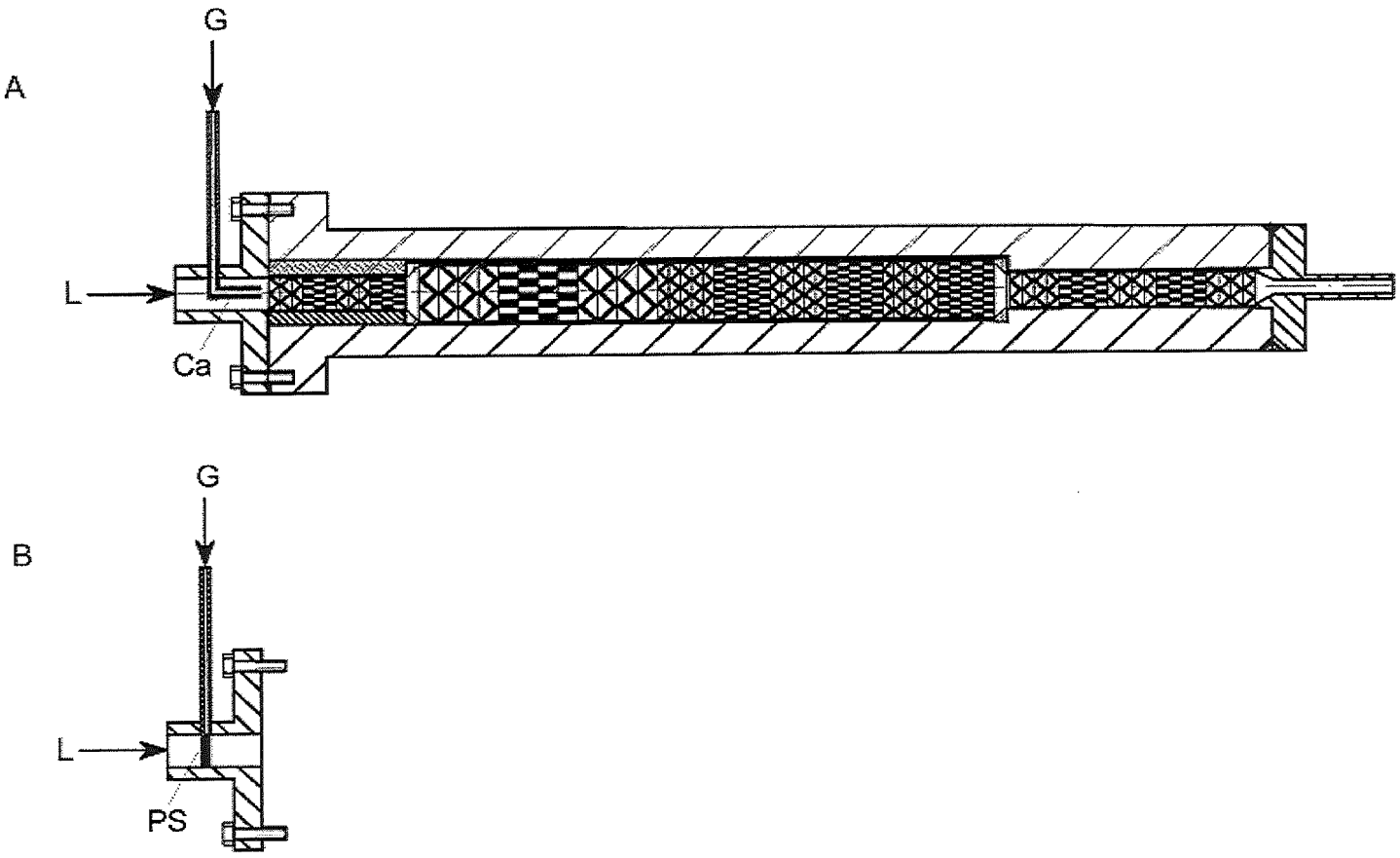
FIG. 3 shows a device with three zones and a premixer and gas metering via a capillary and gas metering by means of porous sintered bodies.

FIG. 3A shows a device according to the invention with three zones and a premixer and gas metering via a capillary. Upstream of the premixer is the region in which the fluid is metered (L) and a device for metering gases (G) via a capillary (Ca).

FIG. 3B shows gas metering by means of porous sintered bodies (the underlying mixer is not shown here). Upstream of the premixer are located the region in which the fluid is metered (L) and a device for gas metering (G) via a porous sintered body (PS), which is located within the flow cross section.

The invention claimed is:

1. A device for dispersing gas in a liquid comprising a number n of successive zones $Z_1, Z_2, \ldots, Z_n$ comprising static mixing elements having channels, each zone $Z_i$ having a length $L_i$, the mixing elements in zone $Z_i$ having an effective diameter $D_i$, wherein the individual zones $Z_i$ are constructed such that a mechanical energy input $E_i$ normalized to the respective ratio $L_i/D_i$ increases from zone to zone in a direction of flow through the device, wherein n is an integer greater than or equal to 3 and i is an index which runs through integers from 1 to the number of zones n, and the mixing elements present in the zones $Z_1$ to $Z_n$ have a same ratio $d_i/D_i$ and an effective diameter $D_i$ which becomes increasingly smaller from zone to zone in the direction of flow, wherein:

$d_i$ is an effective channel diameter averaged arithmetically over all of the channels of the mixing elements in zone $Z_i$, the effective diameter $D_i$ is calculated as $$D_i = \sqrt{\frac{4A_i}{\pi}},$$

the effective channel diameter $d_i$ is calculated as $$d_i = \sqrt{\frac{4a_i}{\pi}},$$

$A_i$ is the cross-sectional area of the mixing elements in each zone $Z_i$, and $a_i$ is the sum of projected free cross-sectional areas of the channels of the mixing elements in each zone $Z_i$.

2. The device as claimed in claim 1, wherein the zones $Z_1$ to $Z_n$ comprise mixing elements of different types, which at the same ratio $L_i/D_i$ cause an increasing pressure drop from zone to zone in the direction of flow.

3. The device as claimed in claim 1, wherein there is a first zone $Z_0$, which achieves a higher specific energy input $E_0$ than the next zone $Z_1$ in the direction of flow.

4. The device as claimed in claim 1, further comprising a tube or a thin capillary for feeding gas into the device, wherein the tube or the thin capillary is mounted upstream of the mixing elements.

5. The device as claimed in claim 1, further comprising a porous or screen-like body for feeding gas into the device wherein the body is mounted upstream of the arrangement of mixing elements.

6. A method for dispersing gas in a liquid comprising flowing a mixture of the gas and liquid through a number n of successive zones $Z_1, Z_2, \ldots, Z_n$ comprising static mixing elements, each zone $Z_i$ having a length $L_i$, the mixing elements having channels, in zone $Z_i$ having an effective diameter $D_i$, wherein a mechanical energy input $E_i$ acting on the gas and liquid mixture and normalized to the respective ratio $L_i/D_i$ increases from zone to zone in the direction of flow, wherein n is an integer greater than or equal to 3 and i is an index which runs through integers from 1 to the number of zones n, and the mixing elements present in the zones $Z_1$ to $Z_n$ have a same ratio $d_i/D_i$ and an effective diameter $D_i$ which becomes increasingly smaller from zone to zone in the direction of flow, wherein:

$d_i$ is an effective channel diameter averaged arithmetically over all of the channels of the mixing elements in zone $Z_i$, the effective diameter $D_i$ is calculated as $$D_i = \sqrt{\frac{4A_i}{\pi}},$$

the effective channel diameter $d_i$ is calculated as $$d_i = \sqrt{\frac{4a_i}{\pi}},$$

$A_i$ is the cross-sectional area of the mixing elements in each zone $Z_i$, and $a_i$ is the sum of projected free cross-sectional areas of the channels of the mixing elements in each zone $Z_i$.

7. The method according to claim 6, wherein the liquid has a viscosity of between 2 mPa·s and 10,000,000 mPa·s.

8. The method according to claim 7, wherein the liquid has a viscosity of between 1,000 mPa·s and 1,000,000 mPa·s.

* * * * *